United States Patent [19]

Murray

[11] 4,448,049

[45] May 15, 1984

[54] SECURITY TIE-DOWN APPARATUS

[76] Inventor: Avon R. Murray, 5031 S. 131st Street, Omaha, Nebr. 68137

[21] Appl. No.: 394,498

[22] Filed: Jul. 2, 1982

[51] Int. Cl.[3] ..... E05B 69/00

[52] U.S. Cl. ..... 70/58; 52/27; 70/DIG. 57

[58] Field of Search ..... 52/27; 70/231, 58, DIG. 57

[56] References Cited

U.S. PATENT DOCUMENTS

| | | | |
|---|---|---|---|
| 3,859,826 | 1/1975 | Singer et al. | 70/58 |
| 4,118,902 | 10/1978 | Saxton | 52/27 |
| 4,302,137 | 11/1981 | Hart | 70/231 X |
| 4,305,266 | 12/1981 | Lockwood | 70/DIG. 57 X |

*Primary Examiner*—Carl D. Friedman

*Attorney, Agent, or Firm*—Zarley, McKee, Thomte, Voorhees & Sease

[57] ABSTRACT

A security tie-down apparatus includes an anchor bolt having a base plate secured thereto in axially spaced relation from the bolt head. A disk is rotatably carried on the anchor bolt between the base plate and head and surrounds the head so as to prevent grasping of the head by conventional tools. Such an anchor screw assembly may be fastened to each end of an elongated connector for securement of one anchor screw assembly to an object to be protected and securement of the other to a more permanent object or surface. Additional hold-down bolts may be provided for independently securing the base plate to the object and offset access holes through the disk enable passage of the hold-down screws therethrough. A special wrench key includes posts insertable through the access holes and into the hold-down screw holes of the base plate for applying torque to the anchor bolt.

12 Claims, 5 Drawing Figures

SECURITY TIE-DOWN APPARATUS

BACKGROUND OF THE INVENTION

The present invention is directed generally to a device for attaching a small item to a larger one for security purposes and more particularly to a device for securing a portable object relative to a permanent structure.

It is well known that thefts can be prevented not only by absolute security but also by devices and systems which would delay or otherwise hamper the quick and easy removal of an object. Thus the theft of television sets, stereos and kitchen appliances such as microwave ovens, for example, may be prevented by securing these objects to the adjacent floor, walls or a post, etc. The problem is that ropes, chains or cables used for this purpose generally have to either surround or be passed through the object and fastened with some type of lock. When so attached, these systems are rather large, bulky, and awkward to secure. In addition, such tie-down systems often result in a rather unsightly attachment to an otherwise attractive appliance or object.

Accordingly, there is a need for a small, less conspicuous and more secure, versatile and functional apparatus for tying down objects for security purposes.

SUMMARY OF THE INVENTION

The security tie-down apparatus of the present invention includes an anchor screw having a base plate fixed thereto in axially spaced relation from the head thereof and a disk rotatably carried on the anchor screw between the head and base plate. The disk surrounds the head so as to prevent access to it with a conventional wrench. The anchor screw is adapted to be fastened to an object to be protected. Additionally, the base plate is provided with a plurality of hold-down screw holes so as to be independently fastened to the object. The disk is provided with access holes which are slightly offset relative to the hold-down screw holes of the base plate so as to hammer the quick removal of the holddown screws therefrom. Even if the hold-down screws are removed, the rotatable disk prevents access to the anchor screw for applying torque to it with conventional wrenches.

The invention also contemplates a wrench key consisting of a base member having a plurality of pins extending from one side thereof and positioned for insertion through the disk access holes and into the hold-down screw holes of the base plate. The wrench key is also provided with a hexhead, handle or the like for the application of torque to the anchor screw by means of the base plate.

A similar anchor screw, disk and base plate assembly may be secured to the floor, wall or post adjacent the object and an attractive cloth covered chain or cable may interconnect the two tie-down apparatus to prevent the theft of the protected object.

DESCRIPTION OF THE PREFERRED EMBODIMENTS

Figure 1:
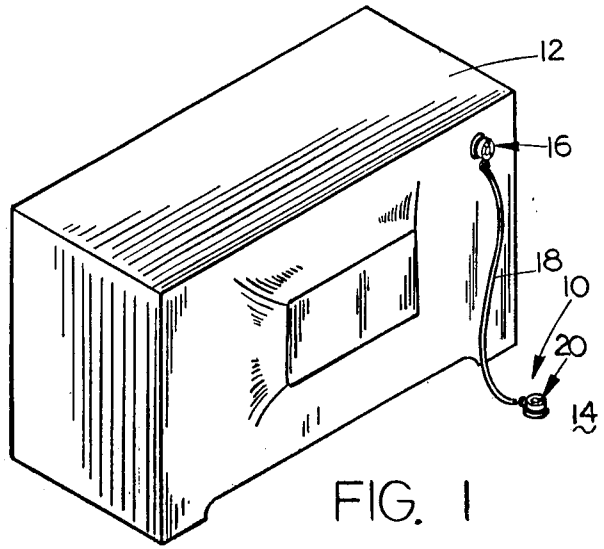
FIG. 1 is a perspective view of a television set anchored to the floor by the tie-down apparatus of the invention.

The security tie-down apparatus 10 of the present invention is shown in FIG. 1 as applied for anchoring a console type television set 12 to the floor 14. A first anchor screw assembly 16, which is secured to the back wall or case of the television set, is connected by an elongated covered chain, cable or the like 18 to a second anchor screw assembly 20 which is secured to the floor.

Figure 2:
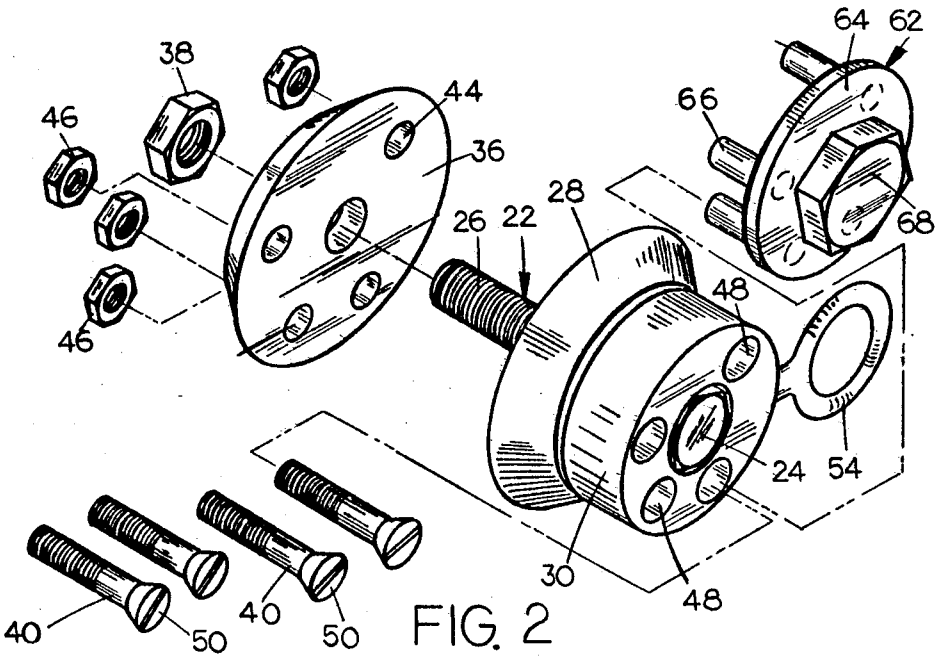
FIG. 2 is an exploded perspective view of the anchor screw, disk and base plate assembly of the invention and the wrench key therefor.
Figure 3:
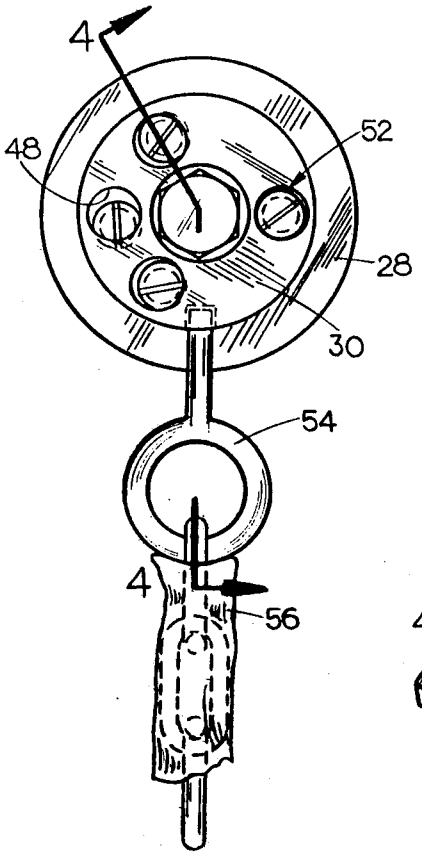
FIG. 3 is a top plan view of the apparatus of the invention.
Figure 4:
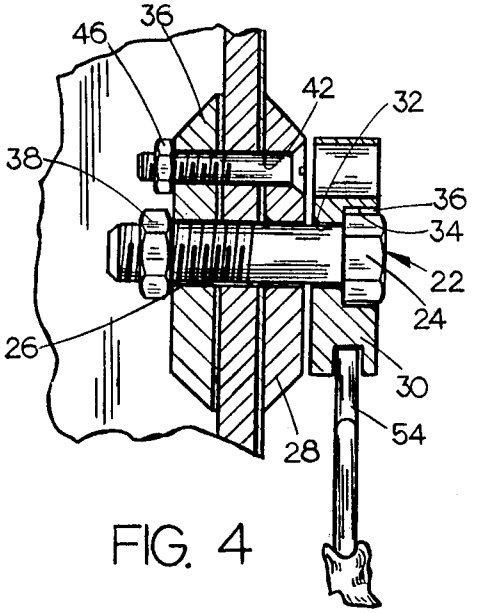
FIG. 4 is a partial sectional view taken along line 4—4 in FIG. 3.

The structure and parts of the first anchor screw assembly 16 are illustrated in FIGS. 2–4. An anchor screw 22 has a hexhead 24 and an elongated threaded shaft 26. A flat base 28 is fixed to the anchor screw 22 by welding or the like in axially spaced relation from the head 24. The anchor screw 22 and base plate 28 are thus fixed together for rotation in unison.

A disk 30 is rotatably carried on the anchor screw between the base plate 28 and head 24. As shown in FIG. 4, disk 30 has a center hole 32 of a diameter slightly greater than the anchor screw shaft 26. The center hole 32 also has an enlarged diameter end recess 34 of slightly greater diameter than the greatest diameter of the anchor screw head 24 thereby providing a slight clearance 36 which is too small to prevent the insertion of pliers, a socket or the like. The recess 34 is at least almost as deep as the thickness of anchor screw head 24, again to prevent grasping of the anchor screw with a conventional tool.

A second base plate 36 may be provided which acts somewhat like a washer for engaging the opposite side of an object prior to fastening nut 38 onto the anchor screw 22 as shown in FIG. 4.

Base plate 28 is also independently secured to the object by a plurality of hold-down screws or bolts 40. For this purpose, the base plate is provided with a plurality of circumferentially spaced apart and counter sunk hold-down screw holes 42 which may be randomly arranged for a particular apparatus. The second base plate 36 is provided with aligned hold-down screw holes 44 and nuts 46 secure the hold-down bolts 40 in place as shown in FIG. 4. The term "hold-down screw holes 44" refers to those holes adapted to receive either hold-down screws or bolts.

Disk 30 includes a plurality of access holes 48 to enable the insertion and removal of the hold-down screws into and from the base plates. The access holes 48 are of diameter to permit passage of the screw heads therethrough. The center lines of the access holes 48 are somewhat offset from the center lines of the hold-down screw holes 42 however to impede or at least delay removal of the hold-down screws 40. In FIG. 3, it is seen that whereas the dotted line hold-down screw holes 42 are simultaneously registerable with the access holes 48 in the disk 30, the enlarged heads 50 are not simultaneously registerable with the slightly offset access holes. Accordingly, when the disk is positioned for insertion and removal of one hold-down screw as indicated at 52, the disk must be slightly rotated to accommodate the insertion and removal of any of the other hold-down screws 40.

An eyelet post 54 is inserted into a radial opening in the periphery of disk 30 and fixed therein by welding or the like to provide a means for connection to the chain 18. The chain may be covered by a fabric sleeve 56 which may be of a color to match the object or floor covering so as to be as inconspicuous as possible.

For connection of the opposite end of the chain 18 to the floor 14, the anchor screw 58 thereof is provided as a lag screw which can be threaded directly to the wood floor material. It is apparent that a bolt adapted for anchoring the structure in concrete or any other type material could be substituted as well. Likewise, the hold-down screws 60 are provided with a type of threads for direct insertion into wood or another material. It is apparent that the second assembly thus requires no second base plate or nuts. The base plate 28 and disk 30 of the second anchor screw assembly 20 may be identical to the corresponding parts of the first anchor screw assembly 16.

For installation of the first anchor screw assembly 16, a center hole for anchor screw 22 is first drilled after which additional holes are drilled in alignment with hold-down screw holes 42 of the base plates. Anchor plate 22 is then inserted through the center hole and the second base plate 36 and nut 38 are placed thereon. The base plates are rotatably aligned for insertion of the hold-down screws 40 and application of the nuts 46. Note that after each hold-down bolt 40 is inserted, the disk 30 must be slightly rotated to accommodate the insertion of the next hold-down bolt.

Figure 5:
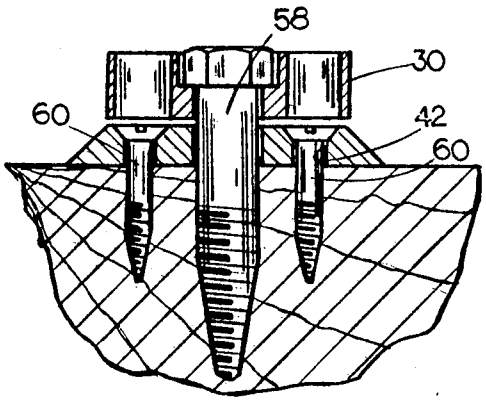
FIG. 5 is a sectional view, similar to FIG. 4, of a second embodiment of the invention.

Removal of the device is accomplished by reversing the above procedure. For the second anchor screw assembly 20 of FIG. 5, only pilot holes need be drilled for the anchor screw 58 and hold-down screws 60.

To enable the application of torque to the anchor screw head 24, a wrench key 62 is provided which includes a base member 64 having a plurality of posts 66 extended from one side thereof in alignment with the hold-down screw holes 42. A hexhead 68 on the opposite side of the base member enables engagement by a wrench or socket. When the hold down screws or bolt 40 are removed, the wrench key posts 66 are insertable through the disk access holes 48 and into the hold-down screw holes 28 in base plate 28, whereupon the wrench key is operable to control the rotation of the anchor screw 22.

Once installed, it will be apparent to a thief that removal of the object will necessitate the separate removal of the four hold-down screws 40 and that this may be complicated by misalignment of the disk access holes 48. Removal will still be thwarted however by the fact that the anchor screw head 24 is inaccessible with conventional tools. It is contemplated that the presence of the security tie-down apparatus of the present invention will sufficiently discourage theft of the object that no attempt to steal it will be made.

Whereas a preferred embodiment of the invention has been shown and described herein, it will be apparent that many modifications, substitutions and alterations may be made which are within the intended broad scope of the invention as defined in the appended claims. Whereas the round tapered peripheral edge of the base plate is preferred for preventing grasping by conventional tools, it is contemplated that other nonlinear shapes are also possible.

Thus there has been shown and described a security tie-down apparatus which accomplishes at least all of the stated objects.

I claim:

1. A security tie down apparatus comprising, an anchor screw adapted to be fastened to an object and having a head to be positioned exteriorly of the object, a base plate fixed to the anchor screw in axially spaced relation from the head thereof and adapted to engage the object to be secured, a disk rotatably carried on said anchor screw and surrounding the head thereof so as to prevent grasping of the head by a wrench, a plurality of hold-down screw holes in said base plate adapted for receiving hold-down screws to independently fasten said base plate to the object to be secured, said disk including at least one access hole which is registerable with at least one of said hold-down screw holes to provide for the insertion and removal of a hold-down screw therethrough, and means for securing an elongated connector to one of said anchor screw, base plate and disk.

2. The apparatus of claim 1 wherein said disk includes a plurality of access holes, at least one of said access holes having a center line which is offset from the center line of a corresponding hold-down screw hole at a position of the disk wherein another access hole is aligned with the corresponding hold-down screw hole whereby rotation of said disk from said position is necessary for the insertion of a hold-down screw through said one access hole and into the corresponding hold-down screw hole.

3. The apparatus of claim 1 wherein said disk includes a hole through which said anchor is rotatably received, said hole having an enlarged diameter end recess of slightly greater diameter than the greatest diameter of said head.

4. The apparatus of claim 3 wherein the depth of said recess is approximately equal to the thickness of said anchor screw head.

5. The apparatus of claim 1 further comprising a wrench key comprising a base member, a plurality of axially extending pins on one side of said base member and positioned for registration with said hold-down screw hole, and means for grasping said wrench key to control the rotation thereof.

6. The apparatus of claim 5 wherein said means for grasping said wrench comprises a head portion on a side of said base member opposite to said pins.

7. The apparatus of claim 5 wherein said hold-down screw holes are countersunk thereby having head receiving portions of greater diameter than shaft receiving portions thereof, said shaft receiving portions being simultaneously registrable with the access holes of said disk whereby said wrench key pins are insertable through said access holes of the disk and into said hold-down screw holes of said base plate whereby said wrench key is operable for applying torque to said anchor screw.

8. The apparatus of claim 7 wherein the head receiving portion of at least one hold-down screw hole is offset from the corresponding access hole at the position of the disk wherein the shaft receiving portions are simultaneously registered with the access holes.

9. The apparatus of claim 1 further comprising an elongated connector having one end secured to one of said anchor screw, base plate and disk and further comprising a second anchor screw, disk and base plate assembly secured to the opposite end of said elongated connector.

10. The apparatus of claim 9 wherein said elongated connector is one selected from the group consisting of chain, rope and cable.

11. The apparatus of claim 1 wherein said anchor screw comprises a bolt having a threaded end adapted to receiving a nut thereon.

12. The apparatus of claim 1 wherein said anchor screw comprises a lag screw.

* * * * *